United States Patent [19]

Yokoi

[11] Patent Number: 4,971,468

[45] Date of Patent: Nov. 20, 1990

[54] SHEET FEEDING APPARATUS IN A PRINTER

[75] Inventor: Takeshi Yokoi, Kagamigahara, Japan

[73] Assignee: Brother Kogyo Kabushiki Kaisha, Aichi, Japan

[21] Appl. No.: 448,331

[22] Filed: Dec. 11, 1989

Related U.S. Application Data

[62] Division of Ser. No. 247,670, Sep. 22, 1988, Pat. No. 4,913,574.

[30] Foreign Application Priority Data

Sep. 30, 1987 [JP] Japan ..... 62-247485
Nov. 13, 1987 [JP] Japan ..... 62-288084

[51] Int. Cl.[5] ..... B41J 13/02
[52] U.S. Cl. ..... 400/634; 400/636.2
[58] Field of Search ..... 400/624, 625, 629, 630, 400/634, 636, 636.2, 639, 616, 616.1, 616.2, 616.3; 101/219, 225, 228

[56] References Cited

U.S. PATENT DOCUMENTS 1,078,096 11/1913 Ielfield .
3,718,245 2/1973 Priebell et al. .
3,722,655 3/1973 Singer .
3,767,023 10/1973 Effinger .
3,884,341 5/1975 Wagner ..... 400/634
4,090,410 5/1978 Nakamura .
4,247,212 1/1981 Wu .
4,248,415 2/1981 Steinhilber .
4,268,021 5/1981 Rutishauser et al. .
4,269,522 5/1981 Levinson et al. .
4,360,279 11/1982 Sugiura .
4,729,683 3/1988 Staniszewski .
4,787,764 11/1988 Ikeda et al. ..... 400/634

FOREIGN PATENT DOCUMENTS 133922 1/1979 Fed. Rep. of Germany .
2941816 5/1981 Fed. Rep. of Germany .
58-0183278 10/1983 Japan .
59-0164169 9/1984 Japan .
2131351 6/1984 United Kingdom .

*Primary Examiner*—Eugene H. Eickholt
*Attorney, Agent, or Firm*—Oliff & Berridge

[57] ABSTRACT

A sheet feeding apparatus in a printer is provided with: feeding rollers for holding and feeding a sheet of paper therebetween; and an operation lever for changing the contact pressure of the feeding rollers by attaching or detaching the feeding roller to or from the opposite feeding roller depending on a type of sheet, e.g., a continuous form transferred by pin tractors or a manually inserted cut sheet. The operation lever also connects or disconnects a clutch mechanism provided between a drive motor and the pin tractors simultaneously with the attaching/detaching operation for the feeding rollers. A single operation of the operation lever can achieve a precise transfer of a selected type of sheet while suspending another type of sheet in the printer. The sheet feeding apparatus is also provided with a transmission mechanism for transmitting a torque between the platen and the feeding rollers by a friction driving force. The transmission mechanism prevents the inertia force of the platen from rotating the feeding rollers uselessly.

13 Claims, 11 Drawing Sheets

SHEET FEEDING APPARATUS IN A PRINTER

This is a division of application Ser. No. 247,670, filed Sept. 22, 1988, now U.S. Pat. No. 4,913,574.

BACKGROUND OF THE INVENTION

The present invention relates to a sheet feeding apparatus in a printer, and more particularly to a sheet feeding apparatus which can properly feed both a continuous form and cut sheets.

Many conventional printers are provided with paper feeding rollers, which are driven by a drive motor, at upstream and downstream sides of the platen in a paper feed direction. In order to prevent friction on the platen, the platen and these paper feeding rollers are engaged with each other by way of a series of gears, toothed belts and pulleys, and the like, so that the platen is rotated synchronously with and at the same speed as the paper feeding rollers driven by the drive motor.

Some sheet feeding apparatuses in these printers can selectively feed a continuous form and cut sheets. More specifically, a continuous form having feed holes at both side edges thereof is fed to the printing position on the platen by way of a first paper path including pin tractors, while cut sheets are fed to the printing position by way of a second paper path located between the printing position and the first paper path. In these sheet feeding apparatuses, the feeding speed of the paper feeding rollers occasionally becomes higher than that of the pin tractors due to a small dimensional error, even though they are designed to feed a sheet at the same speed. Thus, a provision has been made to feed a continuous form positively by the pin tractors and to cause the continuous form to slip over the paper feeding rollers in case the feeding speed of the paper feeding rollers becomes higher than that of the pin tractors. To elaborate, when a continuous form is selected for printing, the paper feeding rollers on the first paper path are set apart from the sheet and the other paper feeding rollers are set to contact the sheet with weaker pressure. When cut sheets are selected for printing, on the other hand, the paper feeding rollers at both sides of the printing position must contact the sheet with pressure necessary to feed the cut sheets of a variety of thickness only by the friction between the paper feeding rollers and the sheets.

If the paper feeding rollers and the pin tractors are structured to be driven by a single driving source like a motor, cut sheets are not to be printed until the continuous form is removed from the pin tractors or the pin tractors are disconnected from the driving source so as not to feed the continuous form together with the cut sheets.

Therefore, these conventional printers have a problem that it requires two different operations, namely: to attach or detach the feeding rollers to or from their opposite ones; and to connect or disconnect the pin tractors with the driving source. If the continuous form is undesirably pressed by the paper feeding rollers at the front and rear of the printing position because of failure in adjusting the contact pressure of the paper feeding rollers, the pin feed holes at the both side edges of the continuous form will be torn by the pins of the pin tractors which move slower than the paper feeding rollers, or the cut sheets selected for printing can not be fed properly because they are not supported firmly between the paper feeding rollers at the front and rear of the printing position.

As for the platen, it is made of a cylindrical rubber so as to reduce the printing noise as much as possible. The inertia force of the rotating platen necessarily becomes great owing to the weight of the platen, which results in inaccuracy in rotating or stopping the platen in response to the operation of the drive motor. More specifically, because of the inertia rotation of the platen due to its inertia force, a sheet of printing paper is not always fed exactly for a determined amount.

SUMMARY OF THE INVENTION

It is accordingly an object of the present invention to provide a sheet feeding apparatus in a printer which can automatically connect or disconnect a clutch mechanism between a driving source and pin tractors synchronously with a selecting operation for attaching or detaching the feeding rollers to or from the opposite ones in accordance with a type of sheet to be printed.

It is another object of the present invention to provide a sheet feeding apparatus in a printer which can support both a first type of sheet and a second type of sheet and can selectively feed either of the two types.

It is another object of the present invention to provide a sheet feeding apparatus in a printer which can feed a sheet precisely for a desired amount regardless of the inertia force of the platen.

These objects are attained by a sheet feeding apparatus in a printer comprising: a cylindrical platen rotatably attached opposite to a printhead; a paper feeding means for feeding a sheet of paper through between said printhead and said platen; and a transmission frictionally connected with said platen for transmitting the torque on said paper feeding means to said platen so as to rotate said platen through friction drive.

The objects are also attained by a sheet feeding apparatus in a printer comprising: a first paper feeding means and a second paper feeding means located at a first position before a printing position and at a second position after the printing position, respectively, for holding and feeding a sheet of paper toward said printing position, said first paper feeding means comprising a first roller and an opposite second roller and said second paper feeding means comprising a third roller and an opposite fourth roller; a first paper path including pin tractors for feeding a first type of sheet, which is provided with pin feed holes on both side edges thereof, into said first paper feeding means by means of said pin tractors whose pins fit in the pin feed holes on said first type of sheet; a second paper path for guiding a second type of sheet toward said first paper feeding means; a torque transmission means for connecting said pin tractors with a driving source of said first and second paper feeding means by way of a clutch means that can be selectively connected and disconnected; an operation means for shifting at least said first roller so as to selectively attach and detach said first roller to and from said second roller; and an interlocking means for connecting said clutch means when said operation means detaches said first roller from said second roller, and for disconnecting said clutch means when said operation means attaches said first roller to said second roller.

BRIEF DESCRIPTION OF THE DRAWINGS

The present invention will be described in more detail with examples and reference to the accompanying drawings. A first embodiment of the present invention is illustrated in FIGS. 1 through 12 wherein.

Figure 13:
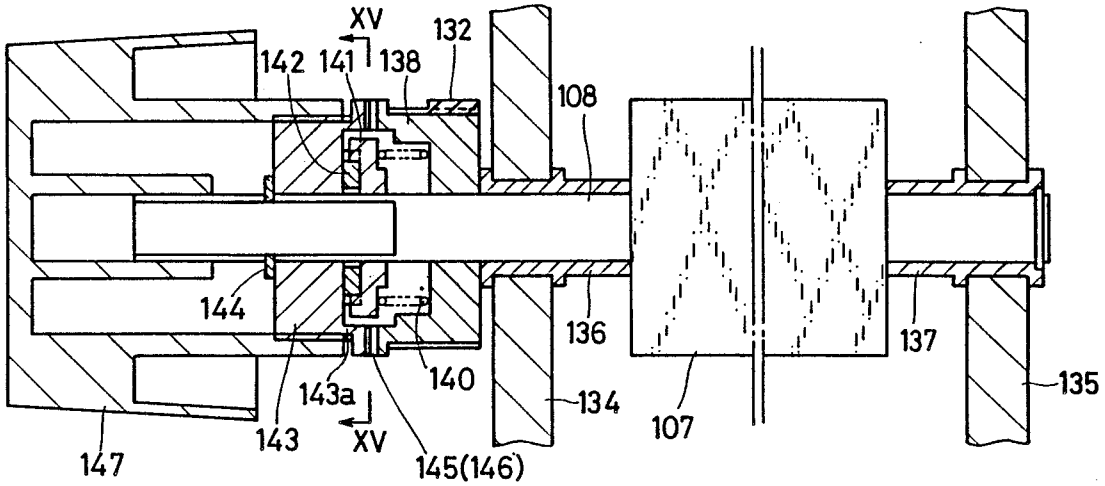
Figure 14:
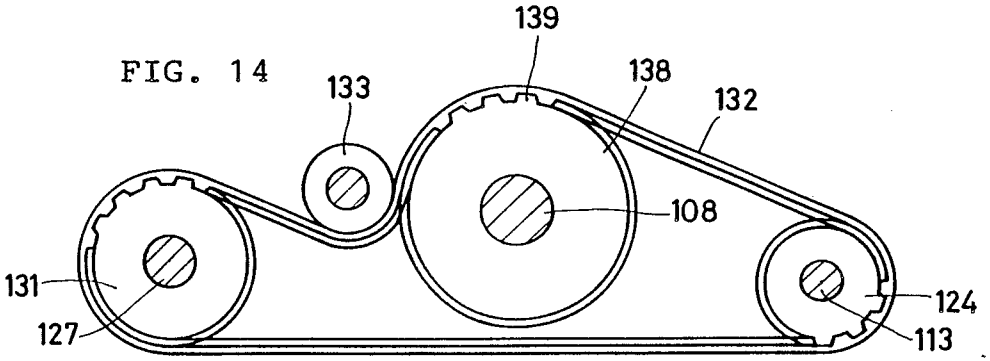
Figure 15:
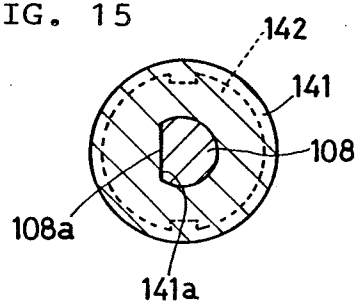
Figure 16:
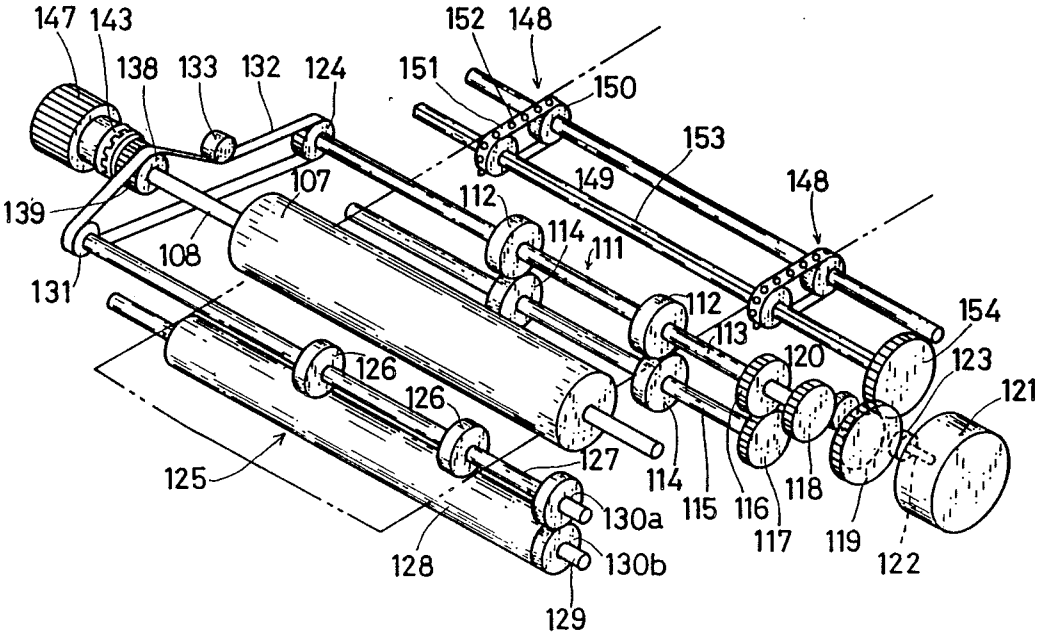
Figure 17:
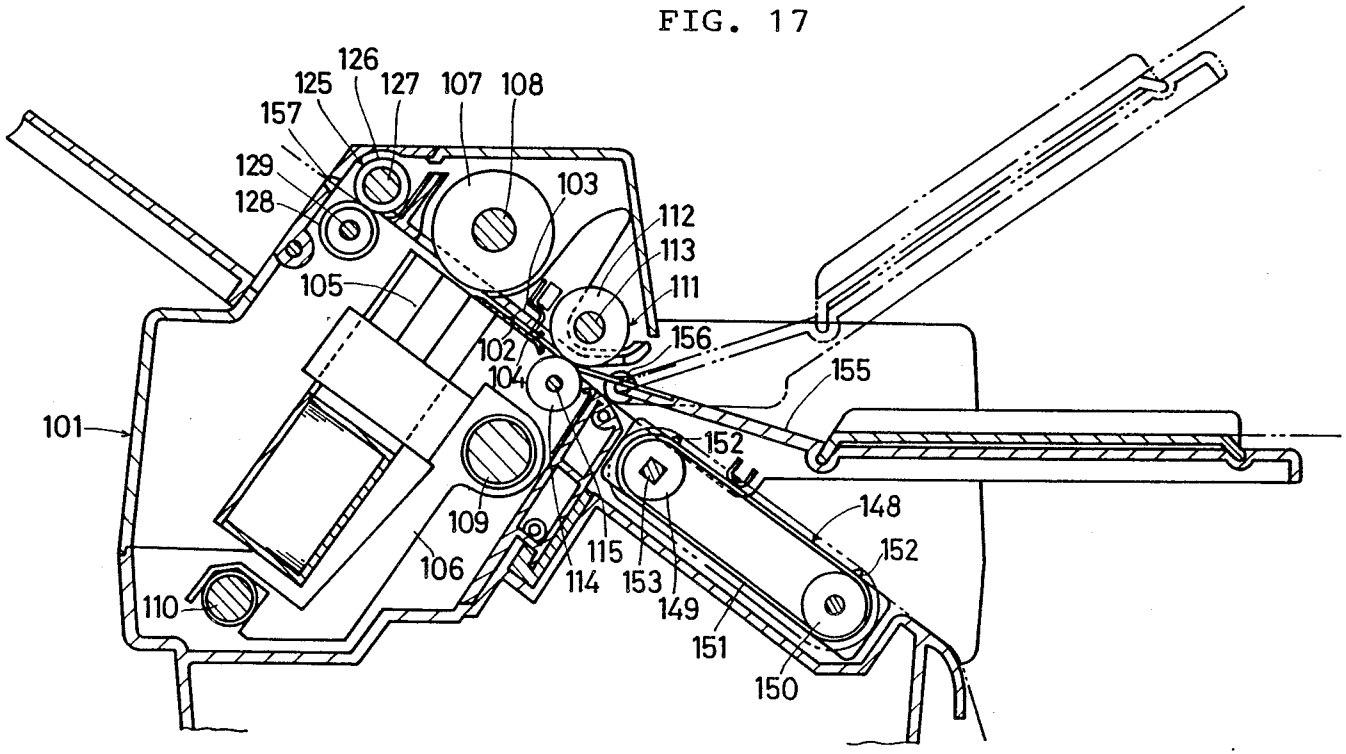

A second embodiment of the present invention is illustrated in FIGS. 13 through 17 wherein:

FIG. 13 is a sectional front view of a main portion of a sheet feeding apparatus in a printer;

FIG. 14 is a sectional view illustrating a collar connected with a toothed belt wound around a driving pulley and a driven pulley in a first and a second paper feeding mechanisms;

FIG. 15 is sectional view taken along a section line XV—XV in FIG. 13;

FIG. 16 is a perspective view showing the whole sheet feeding apparatus in the printer; and FIG. 17 is a longitudinal sectional view of a main portion of the printer.

Figure 18:
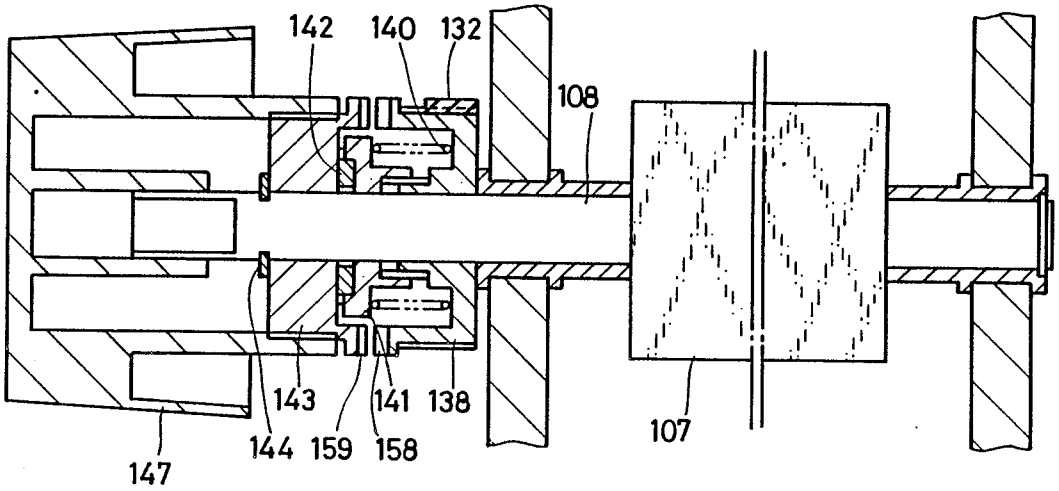

FIG. 18 is a sectional front view of a main portion of a third embodiment of the present invention.

DETAILED DESCRIPTION OF THE EMBODIMENTS

Hereinafter, a printer as a first embodiment of the present invention will be described in detail referring to FIGS. 1 though 12.

Figure 1:
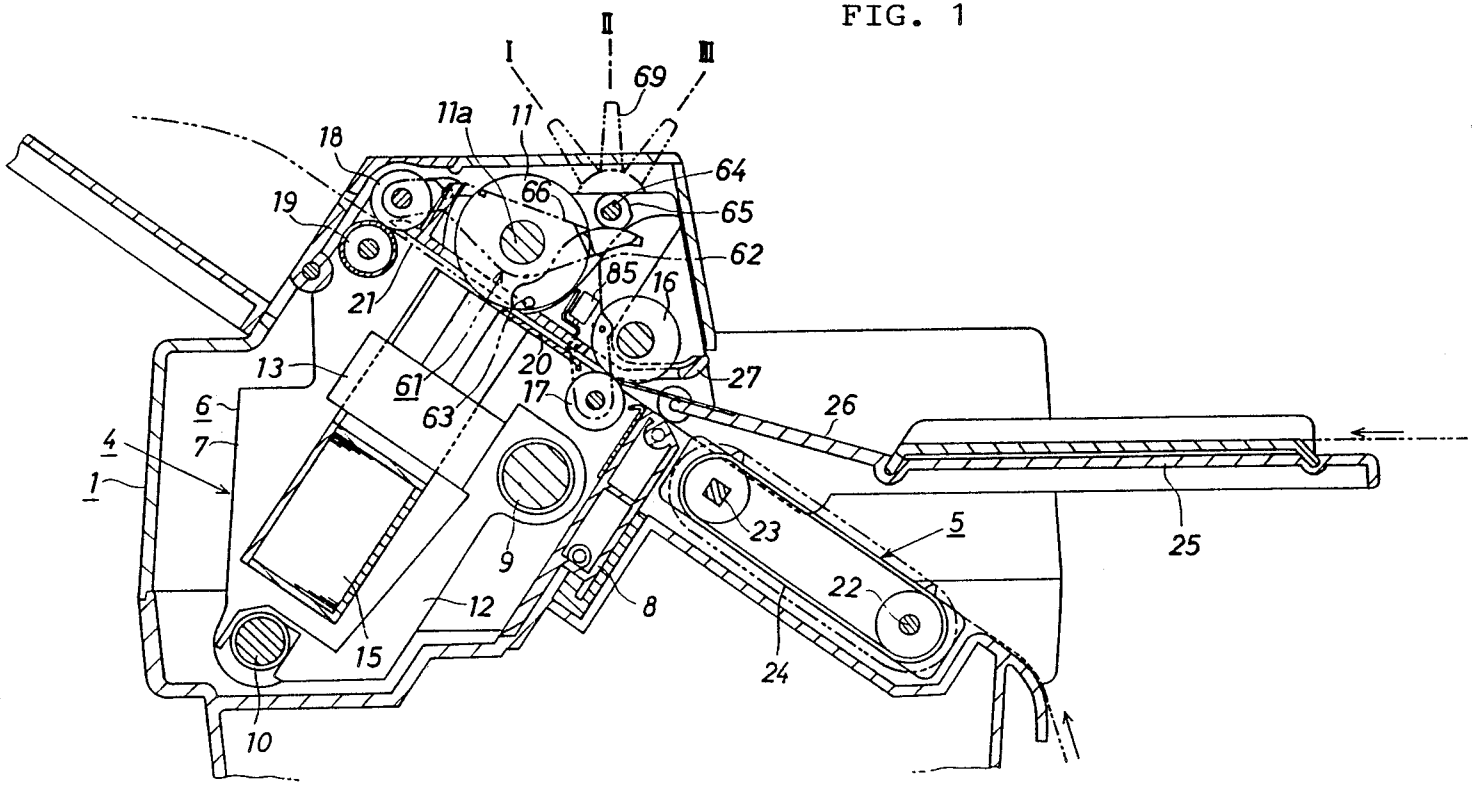
FIG. 1 is a longitudinal sectional view of a main portion of a printer as the first embodiment.
Figure 5:
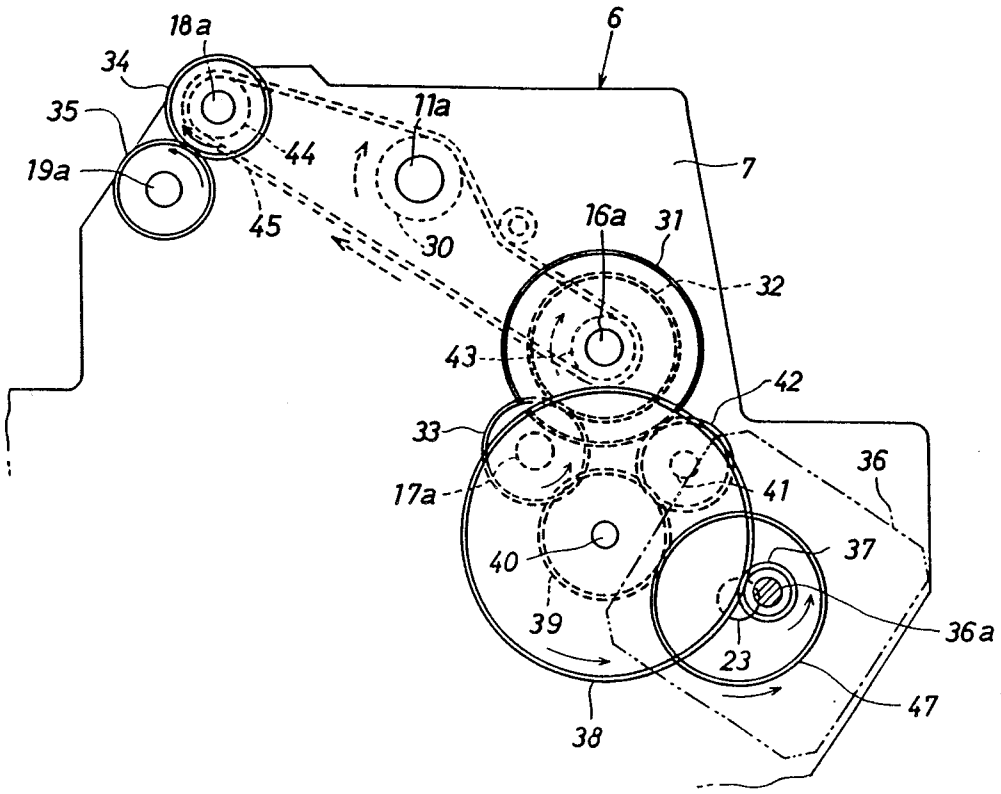
FIG. 5 is a side view illustrating a gear mechanism.

Referring first to FIG. 1, a print mechanical unit 4 is located in one side area of a printer case 1 while a tractor unit 5 is in the other side area thereof. A unit frame 6 of the print mechanical unit 4 consists of a hollow horizontal bar 8 supported between a pair of side frames 7, and two round guide bars 9 and 10. A cylindrical platen 11 is rotatably supported between the side frames 7 and above the guide bars 9 and 10. As shown in FIG. 5, a toothed pulley 30 is attached to one end of a platen shaft 11*a* of the platen 11.

A carriage 12 is supported between the guide bars 9 and 10 movably along the width of the printer, and on the upper portion of the carriage 12 a printhead 13 is located so as to slant upward and face the platen 11 above it. A sheet of paper is printed at a printing position on the platen 11 by means of the printhead 13 via an ink ribbon 15.

A pair of feeding rollers 16 and 17 and another pair of feeding rollers 18 and 19 are located before and after the printing position on the platen 11, respectively, along the paper feed direction and substantially on the tangent line of the printing position. As shown in FIG. 5, the feeding roller 16 has a shaft 16*a* attached with a pair of gears 31 and 32 of different sizes at one end of the shaft 16*a* on the opposite side to the toothed pulley 30 on the platen shaft 11*a*. Similarly, shafts 17*a*, 18*a* and 19*a* of the other feeding rollers 17, 18 and 19 are attached with their respective gears 33, 34 and 35 at their ends. A motor 36 is attached on one of the side frames 7 and its drive shaft 36*a* is attached with a gear 37. Another pair of gears 38 and 39 of different sizes are attached to a shaft 40 in such a manner that the larger gear 38 is engaged with the gear 37 on the drive shaft 36*a* while the smaller gear 39 is engaged with an intermediate gear 42 on a shaft 41 which is engaged with the gear 31 on the roller shaft 16*a*, thereby connecting the gears 37 and 31 with each other. The gear 32 on the shaft 16*a* of the feeding roller 16 is engaged with the gear 33 on the shaft 17*a* of the feeding roller 17, and the gear 34 on the shaft 18*a* of the feeding roller 18 is engaged with the gear 35 on the shaft 19*a* of the feeding roller 19. Toothed pulleys 43 and 44 are attached to the shafts 16*a* and 18*a* , respectively, on the same side as the toothed pulley 30 on the platen shaft 11*a* and on the opposite side to the gears 31, 32, and 34. A transmission belt 45 encircles these toothed pulleys 30, 43 and 44. Upon rotation of the motor 36, the feeding rollers 16, 17, 18, and 19 are rotated in the paper feed direction together with the platen 11 via this transmission mechanism consisting of the gears and the belt, thereby holding and advancing a sheet of paper.

As shown in FIG. 1, a paper path member 20 and a guide member 27 are disposed opposite to each other substantially on the lower side and the upper side, respectively, of the tangent line of the printing position on the platen 11. The paper path member 20, the guide member 27 and the feeding rollers 16 through 19 altogether form a paper guide path 21 passing through the printing position The paper guide path 21 is substantially flat and slants upward to the paper feed direction so that the paper inlet is located lower than the paper outlet.

Figure 4:
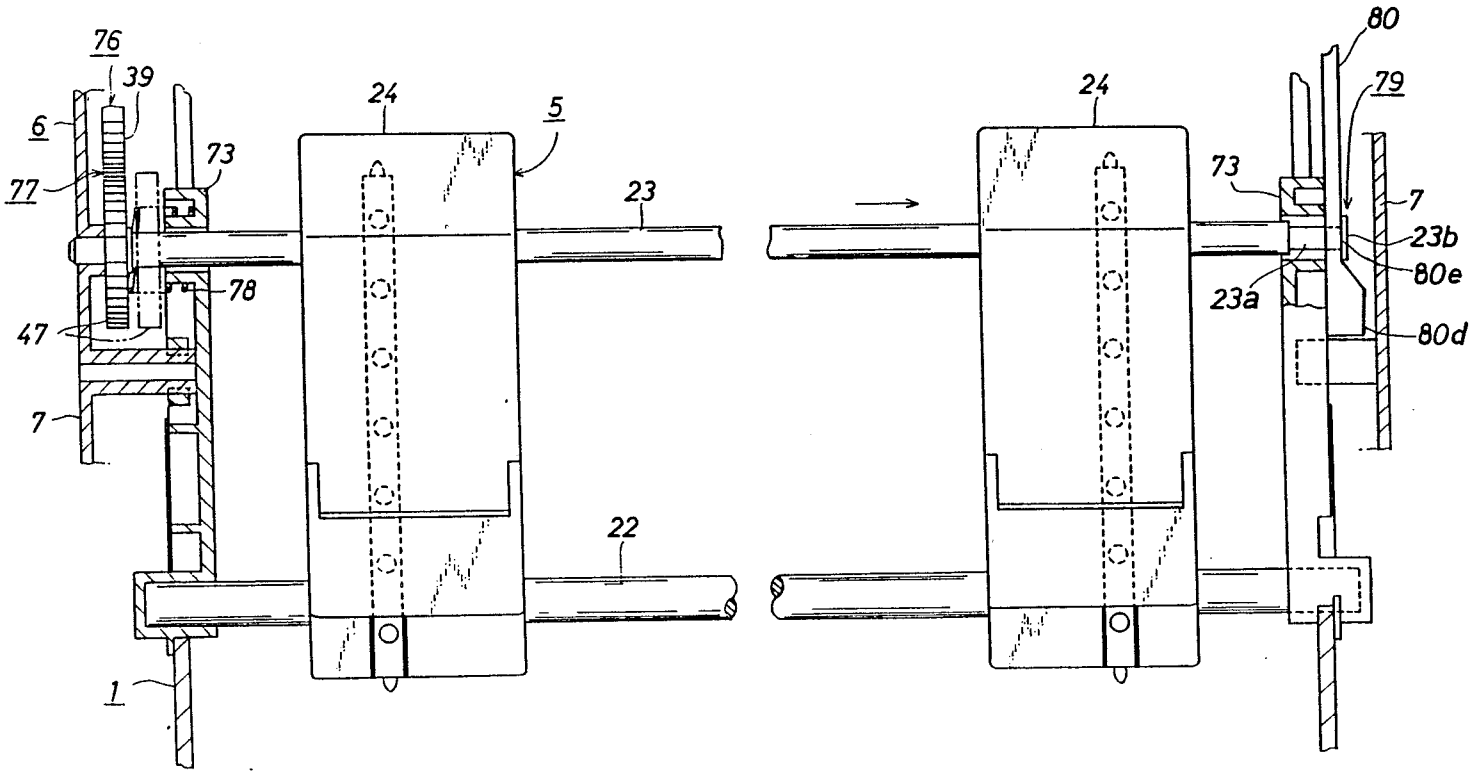
FIG. 4 is a partial transverse sectional view enlarging a structure supporting the tractor unit including the interlock mechanism.

As shown in FIGS. 1 and 4, the tractor unit 5 includes a guide shaft 22 and a transmission shaft 23 which extend in parallel to each other across the width of the printer. The tractor unit 5 also includes a pair of left and right pin tractors 24 supported movably on the shafts 22 and 23 for adjustment across the width of the paper. The upper surface of each pin tractor 24 is disposed on the upstream of the paper guide path 21 substantially in the same plane as the paper guide path 21 so that it slants upward in the paper feed direction. Like an ordinary printer of a similar kind, each pin tractor 24 comprises a pair of pulleys supported on the shafts 22 and 23, and a belt with pins which is wound around the pulleys. The pins on the pin tractors 24 fit in pin feed holes spaced along the outer edges of a continuous form. The upper surface of the pin tractors 24 forms a first paper path for feeding the continuous form onto the paper guide path 21. As shown in FIG. 5, a gear 47 attached on the transmission shaft 23 is engaged with the gear 39. As a result, when the motor 36 rotates the transmission shaft 23, the pin tractor 24 is accordingly rotated so that the continuous form is fed into the paper guide path 21.

A manual guide plate 25 is supported between both side frames 7 of the printing unit frame 6 in the upper position relative to the tractor unit 5. On the upper surface of the manual guide plate 25, a guide plane 26 extends substantially horizontally so as to intersect with the paper guide path 21 at a particular angle. The guide plane 26 of the manual guide plate 25 forms a second paper path along which an individual cut sheet of paper manually inserted is fed into the paper guide path 21.

Figure 6:
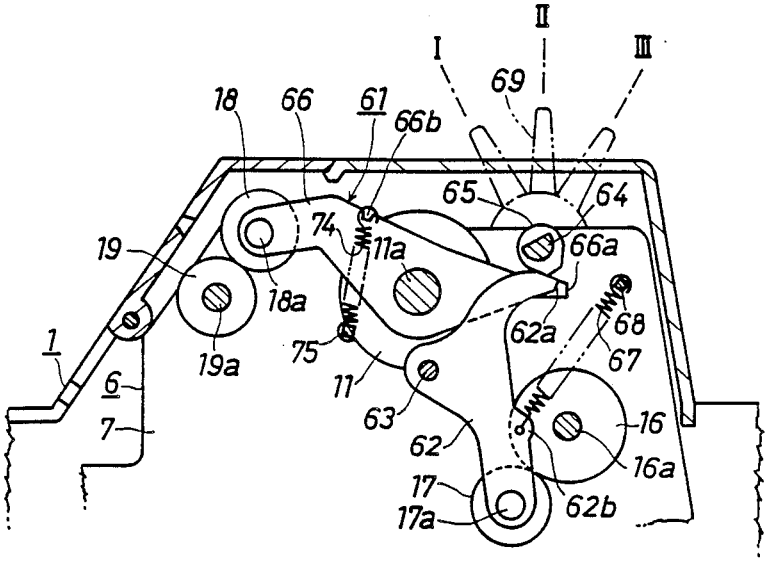
FIG. 6 is a partial sectional view illustrating in detail a connecting structure of support levers on the feeding rollers.

As for an operation mechanism 61, it is provided for attaching or detaching the feeding rollers 17 and 18 to or from a sheet, the feeding rollers 17 and 18 being opposite to each other below and above a sheet and also before and after the printing position. Referring to FIG. 6, a pair of first support levers 62, one of them being shown in the drawing, are rotatably supported on the side frames 7 by a shaft 63 attached at the center of each support lever 62. A press strip 62*a* is provided at one end portion of the support lever 62. A pair of second support levers 66, one of them being shown in the drawing, are rotatably supported on each end of the platen shaft 11*a* of the platen 11, each having a press strip 66*a* at one end portion. On the other end portions of the first and second support levers 62 and 66, both ends of the shafts 17*a* and 18*a* of the feeding rollers 17 and 18 are rotatably attached. The other feeding rollers 16 and 19 are rotatably supported on their specific positions on the side frames 7.

The operation mechanism 61 also comprises an operation shaft 64 rotatably supported between the side frames 7. A pair of cams 65 are provided on each end of the operation shaft 64 so that the cams 65 are connected with the press strips 62*a* and 66*a* on the support levers 62 and 66 as will be described in detail later. A spring 67 is provided between a portion 62*b* of the first support lever 62 and a pin 68 on the side frame 7 so that the first support lever 62 is forced counterclockwise in FIG. 6. As a result, the feeding roller 17 is pressed into contact with the opposite feeding roller 16, and the press strip 62*a* comes into contact with the cam 65. Another spring 74 is provided between a portion 66*b* of the second support lever 66 and a pin 75 on the side frame 7 so that the second support lever 66 is forced counterclockwise in FIG. 6. As a consequence, the feeding roller 18 is pressed against the opposite feeding roller 19 and the press strip 66*a* comes into contact with the cam 65. In this embodiment, the spring 67 has greater resilience than the spring 74 so that the feeding roller 17 located upstream in the paper feed direction presses the sheet more effectively than the feeding roller 18 located downstream.

Figure 2:
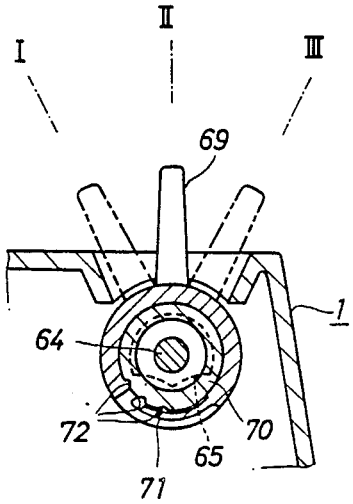
FIG. 2 is a partial sectional view illustrating in detail an operation lever for selectively pressing feeding rollers against a sheet and setting them apart from the sheet.

As shown in FIG. 2, an operation lever 69 is rotatably attached around a support cylinder 70 on one of the side frames 7. At the center of the support cylinder 70, the operation lever 69 is joined with one end of the operation shaft 64. The body portion of the operation lever 69 includes a resilient connecting pin 71 which is selectively engaged with one of three connecting recesses 72 provided around the peripheral surface of the support cylinder 70. Thus, the operation lever 69 can be kept in one of three positions shown by the symbols I, II, and III in FIGS. 1, 2, and 6.

As shown in FIGS. 9 through 12, the cams 65 are structured as a pair of cams 65A and 65B which are connected with the support levers 62 and 66, respectively. The cam 65A has a higher cam plane 65A*a* which lowers the press strip 62*a* of the first support lever 62 against the force of the spring 67 when the operation lever 69 is moved to either the second position II or the third position III. The cam 65A also has a lower cam plane so that the press strip 62*a* springs back to its upper position when the operation lever 69 is moved to the first position I. Similarly, the other cam 65B has a higher cam plane 65B*a* which lowers the press strip 66*a* of the second support lever 66 against the force of the spring 74 when the operation lever 69 is moved to the third position III. The cam 65B also has a lower cam plane so that the press strip 66*a* springs back to its upper position when the operation lever 69 is moved to either the first position I or the second position II.

Figure 9:
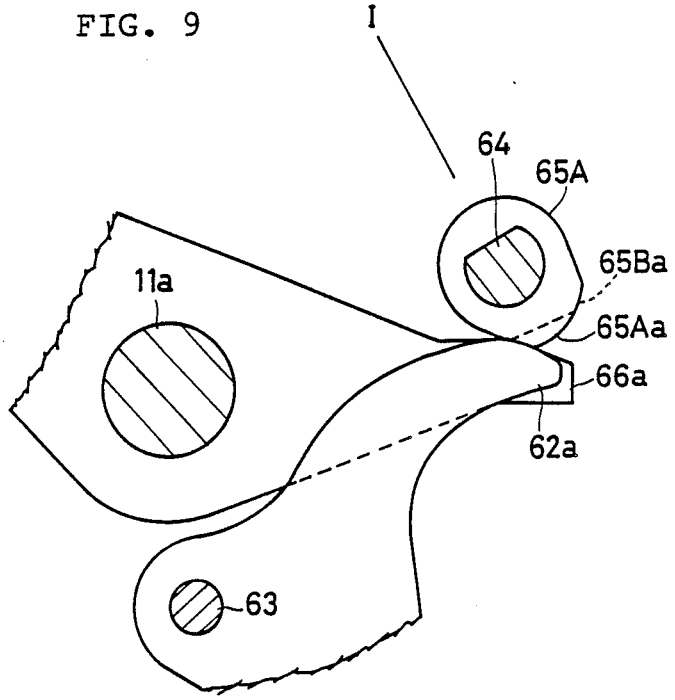
FIGS. 9, 10 and 11 are enlarged sectional views illustrating three states when the operation lever is at its first, second and third positions.
Figure 10:
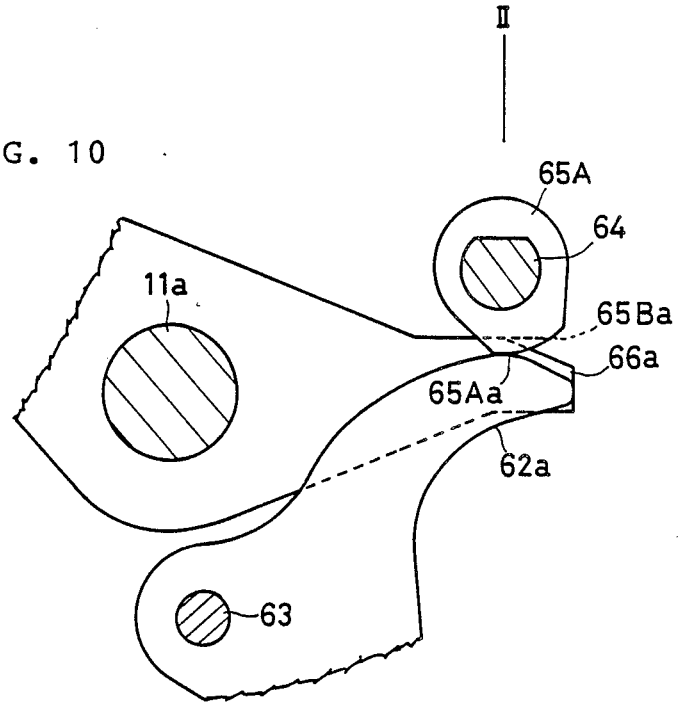
Figure 11:
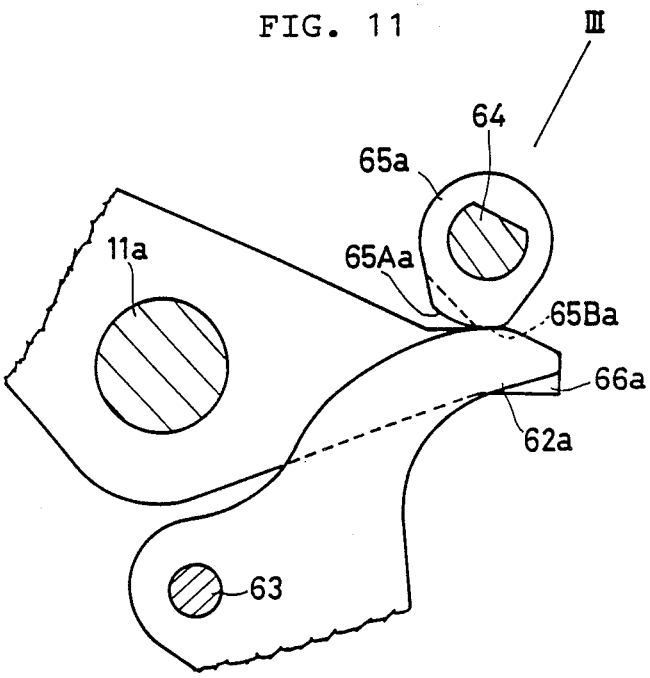
Figure 12:
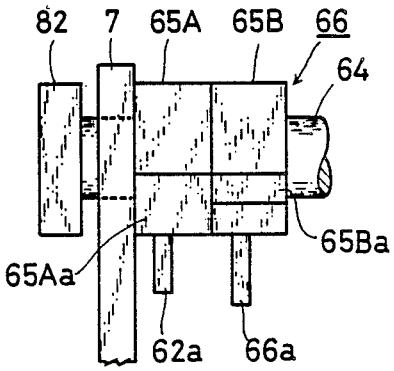
FIG. 12 is an enlarged side view illustrating cams which are connected with the support levers.

When the operation lever 69 is moved to the position I, as shown in FIG. 9, the lower cam planes of both cams 65A and 65B come into contact with the press strips 62*a* and 66*a* of the support levers 62 and 66. The springs 67 and 74 press the feeding rollers 17 and 18 made of rubber against the opposite feeding rollers 16 and 19, thereby holding the sheet with pressure before and after the printing position. When the operation lever 69 is moved to the position II, as shown in FIG. 10, the higher cam plane 65A*a* of the cam 65A comes into contact with the press strip 62*a*. Accordingly, the feeding rollers 17 before the printing position is set apart from the opposite feeding roller 16 against the force of the spring 67. When the operation lever 69 is moved to the position III, the higher cam planes 65A*a* and 65B*a* of both cams 65A and 65B come into contact with the press strips 62*a* and 66*a*, respectively. As a result, the feeding rollers 17 and 18 are set apart from the opposite feeding rollers 16 and 19, thereby releasing the sheet from the pressure.

In case of printing on an individual cut sheet of paper which is manually inserted from the second paper path on the manual guide plate 25 into the paper guide path 21, the operation lever 69 is moved to the position I so as to press the feeding rollers 17 and 18 against the opposite feeding rollers 16 and 19. As a consequence, even if the inserted sheet is so stiff that it is curved against its resiliency through the guide plane 26 and the paper guide path 21, the sheet is held firmly between the feeding rollers 16 and 17 and advanced in the line feed direction by the rotation of the feeding rollers 16 through 19. In case of printing on a continuous form which is fed through the first paper path on the tractor unit 5, the operation lever 69 is moved to the position II so as to set the feeding roller 17 apart from the opposite feeding roller 16 before the printing position As a consequence, the continuous form is fed smoothly by the rotation of the pin tractor 24 and the feeding rollers 18 and 19 after the printing position The spring 74 is provided for pressing the feeding rollers 18 and 19 against each other to such a degree that if the feeding rollers 18 and 19 feed the form faster than the pin tractor 24, the feeding rollers 18 and 19 slip over the form. In case the sheet gets stuck in the paper guide path 21, the operation lever 69 is moved to the position III so as to set the feeding rollers 17 and 18 apart from the opposite feeding rollers 16 and 19. As a result, the stuck paper is easily removed out of the paper guide path 21.

Hereinafter a description will be given for a mechanism for connecting or disconnecting the pin tractors 24 with the motor 36 synchronously with the alternation of the holding pressure of the feeding rollers 17 and 18 by the operation lever 69. Referring to FIG. 4, the tractor unit 5 has a frame structure with a pair of tractor unit frames 73 which support both ends of the guide shaft 22.

The transmission shaft 23 is supported between the tractor unit frames 73 rotatably and movably in the direction of the shaft line thereof. The gear 47 on the transmission shaft 23 is connected and disconnected with the gear 39 based on the axial movement of the transmission shaft 23. Including these gears 47 and 39, a torque transmission mechanism 76 consists of plural gears provided between the transmission shaft 23 and the motor 36. In the present embodiment, a clutch 77 is provided for connecting and disconnecting a torque transmission course by means of the gears 47 and 39 which are removably engaged with each other. Normally a spring 78 forces the transmission shaft 23 to the left in FIG. 4 so that the gear 47 is engaged with the gear 39 to maintain the clutch 77 in the connected state.

Figure 3:
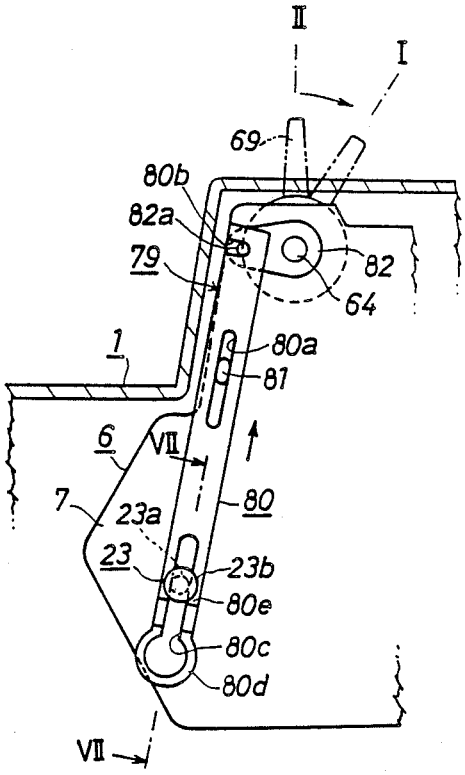
FIG. 3 is a partial sectional side elevation illustrating an interlock mechanism for connecting and disconnecting a tractor unit with a driving source in response to the selecting operation for attaching or detaching the feeding rollers to or from the opposite ones.

Referring to FIGS. 3 and 4, an interlocking member 79 is provided between the operation shaft 64 of the operation mechanism 61 and the transmission shaft 23 of the tractor unit 5. The interlocking member 79 connects and disconnects the clutch 77 synchronously with the operation mechanism 61. More specifically, a side cam 80 of the interlocking member 79 has a slot 80*a* in the center thereof which receives a pin 81 provided on one of the side frames 7, so that the side cam 80 is supported on the side frame 7 movably up and down. The side cam 80 also has an aperture 80*b* at the upper end and another slot 80*c* at the lower end. A rotating medium 82 is attached to the operation shaft 64 at its end opposite to the operation lever 69. The end portion of the rotating medium 82 has a pin 82*a* which is received in the aperture 80*b* of the side cam 80.

Figure 7:
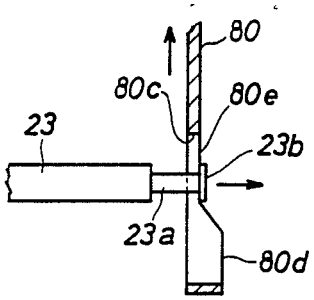
FIG. 7 is a partial sectional view taken along a section line VII—VII in FIG. 3.

As shown in FIGS. 3, 4 and 7, the side cam 80 comprises a higher cam plane 80*d* and a lower cam plane 80*e* on the outer face of the lower end of the side cam 80, thereby providing the side cam 80 with a ledge jutting vertically to the movable direction of the side cam 80. The transmission shaft 23 is provided with a thinner portion 23*a* and a connecting head 23*b* at the opposite end to the gear 39 and 47. The thinner portion 23*a* extends through the slot 80*c* of the side cam 80, and the connecting head 23*b* is connected with either the higher cam plane 80*d* or the lower cam plane 80*e* of the side cam 80.

Figure 8:
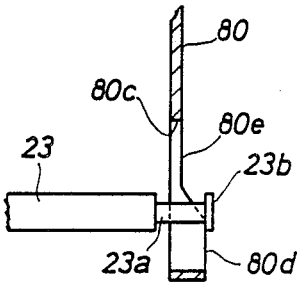
FIG. 8 is another partial sectional view illustrating an alternate operational state for that of FIG. 7.

When the operation lever 69 is moved to either the position II or the position III, the lower cam plane 80*e* of the side cam 80 is connected with the connecting head 23*b* of the transmission shaft 23, as shown in FIGS. 3, 4, and 7, and the clutch 77 is maintained in the connected state by means of the spring 78. Alternatively, when the operation lever 69 is moved to the position I, the rotating medium 82 raises the side cam 80 and the higher cam plane 80*d* of the side cam 80 is connected with the connecting head 23*b* of the transmission shaft 23, as shown in FIG. 8. As a consequence, the transmission shaft 23 is moved to the right in FIG. 4, and the gear 47 is moved across the shaft line apart from the opposite gear 39 so as to put the clutch 77 into the disconnected state Therefore, only a single operation makes it possible to attach or detach the feeding rollers 17 and 18 to or from their respective opposite feeding rollers 16 and 19 and simultaneously to connect or disconnect the clutch 77, and one of the two states can be easily selected.

In the present embodiment, a paper edge sensor 85 is provided between the platen 11 and the upper feeding roller 16 at the upstream side in the paper feed direction so as to detect a leading edge of a continuous form. In case an additional switch (not shown) is operated for putting back the continuous form from the printing position before setting the operation lever 69 into the position I, the motor 36 rotates backward the platen 11, the feeding rollers 16 through 19, and the pin tractor 24 so as to put back the continuous form away from the printing position on the platen 11 until the paper edge sensor 85 detects the leading edge of the continuous form. Thereafter, the motor 36 is stopped after a rotation for a certain number of pulses, so that the leading edge of the continuous form is held at a determined position between the pin tractor 24 and the opposing feeding rollers 16 and 17 at the paper inlet side. In case of printing on an individual cut sheet with the continuous form being suspended in this state, the operation lever 69 is set into the position I so as to disconnect the clutch 77 and to interrupt the torque transmission to the pin tractor 24. Therefore, the continuous form is never fed with the individual cut sheet which is fed by the rotation of the feeding rollers 16 through 19.

Furthermore, when the operation lever 69 is set into the position II and then an additional switch (not shown) is operated for advancing a sheet, the motor 36 rotates forward the platen 11, the feeding rollers 16 through 19 and the pin tractors 24 so as to advance the continuous form until the paper edge sensor 85 detects the leading edge of the continuous form. Thereafter, the motor 36 is stopped after a rotation for a certain number of pulses, so that an initial printing line on the continuous form is disposed opposite to the printing position on the platen 11 where the printhead 13 executes printing.

The present embodiment may be applied to an ordinary printer that feeds a sheet of paper approximately halfway around a cylindrical platen, and that has press rollers pressing the sheet against the platen.

Hereinafter, a second embodiment of the present embodiment is explained with reference to FIGS. 13 through 17.

Referring first to FIGS. 16 and 17, a printer case 101 a pair of upper and lower paper guide members 103 and 104 form a paper guide path 102 therebetween. A carriage 106 provided in the printer case 101 comprises a printhead 105 below the paper guide path 102. A platen 107 opposite to the printhead 105 is attached above the paper guide path 102 rotatably on a platen shaft 108 which extends through the center of the platen 107. The platen 107 is made of a cylinder of rubber in order to reduce the printing noise. A pair of upper and lower guide bars 109 and 110 are provided between side frames of the printer case 101, and a carriage 106 is supported between the guide bars 109 and 110 movably along the width of the printer.

In order to feed a sheet of paper between the printhead 105 and the platen 107, a first and a second paper feeding mechanisms 111 and 125 are provided at the upstream side and at the downstream side, respectively, of the printhead 105 and the platen 107 in the paper feed direction. As shown in FIG. 16, the first paper feeding mechanism 111 comprises: a pair of upper and lower feeding rollers 112 and 114; roller shafts 113 and 115 which extend through the feeding rollers 112 and 114 and are rotatably supported between the side frames of the printer case 101; and gears 116 and 117 which are engaged with each other at each one end of the roller shafts 113 and 115. The upper roller shaft 113 projects for a determined length from the gear 116, and the projecting end of the roller shaft 113 is provided with a driving gear 118. The driving gear 118 is engaged with a first and a second intermediate gears 119 and 120, and finally engaged with an output gear 123 of an output shaft 122 of a drive motor 121. The other end of the upper roller shaft 113 is provided with a driving pulley 124 having teeth around its periphery.

The second paper feeding mechanism 125 comprises: a pair of upper and lower feeding rollers 126 and 128; roller shafts 127 and 129 which extend through the feeding rollers 126 and 128 and are rotatably supported between the side frames of the printer case 101; and gears 130*a* and 130*b* which are engaged with each other at each end of the roller shaft 127 and 129. At the other end of the upper roller shaft 127, a driven pulley 131 having teeth around its periphery is located corresponding to the driving pulley 124. An endless toothed belt 132 encircles the driving pulley 124 and the driven pulley 131 by way of a tension pulley 133 in such a manner that teeth provided on the inner face of the belt 132 are engaged with the teeth on the driving pulley 124 and those on the driven pulley 131. Upon the operation of the drive motor 121, the feeding rollers 112, 114, 126 and 128 in the first and second paper feeding mechanisms 111 and 125 are synchronously rotated.

As described above, the first and second paper feeding mechanisms 111 and 125 are located before and after the platen 107 in such a manner that a contact point of the feeding rollers 112 and 114 and that of the feeding rollers 126 and 128 are both positioned substantially on a tangent line of the circumference of the platen 107.

As shown in FIG. 13, both ends of the platen shaft 108 are rotatably supported in bearings 136 and 137 on side frames 134 and 135. One end of the platen shaft 108 projects for a determined length through the bearing 136, and the projecting portion of the platen shaft 108 are provided with a collar 138, a spring 140, a friction member 141, an intermediate member 143 and an operation knob 147.

The collar 138 is rotatably attached to the platen shaft 108. As shown in FIG. 14, the periphery of the collar 138 is provided with teeth 139 which are engaged with the teeth on the inner surface of the toothed belt 132. Consequently, the collar 138 is rotated together with the toothed belt 132.

Referring to FIG. 13, the friction member 141 is attached to the platen shaft 108 movably in the axial direction of the platen shaft 108 and rotatably together with the platen shaft 108. As shown in FIG. 15, a center hole of the friction member 141 has a contact surface 141*a* which is in contact with a corresponding contact surface 108*a* formed on the chamfered periphery of the platen shaft 108. The friction member 141 is pressed into contact with an intermediate member 143, which will be described later, by a compression spring 140 surrounding the platen shaft 108 between the friction member 141 and the collar 138. A friction disk 142 is provided on one side face of the friction member 141 opposite to the intermediate member 143 so that the friction disc 142 is in contact with the intermediate member 143 in order to transmit a torque therebetween.

The intermediate member 143 is rotatably attached to the platen shaft 108 and secured by a snap ring 144. From the outer rim of one face of the intermediate member 143 opposite to the collar 138, a ring portion 143*a* projects toward the collar 138, thereby surrounding the friction member 141. An end face of the ring portion 143*a* and the opposite face of the collar 138 are provided with engaging teeth 145 and 146, respectively, which are engaged with each other so that the intermediate member 143 and the collar 138 can be rotated together with each other.

The operation knob 147 is rotatably attached to the platen shaft 108 and splined with the intermediate member 143 in such a manner that the operation knob 147 and the intermediate member 143 can be rotated together with each other.

So structured as described above, the platen shaft 108 is rotated in the following manner. Referring to FIG. 13, first, a torque caused by the drive motor 121 is transmitted from the driving pulley 124 on the upper roller shaft 113 of the first paper feeding mechanism 111 to the collar 138 via the toothed belt 132. This torque on the collar 138 is transmitted to the intermediate member 143, the friction member 141 , and finally to the platen shaft 108. Alternatively, a torque caused by turning the operation knob 147 is transmitted to the collar 138 via the intermediate member 143, from which the torque is transmitted to the platen shaft 108 via the friction member 142.

As shown in FIGS. 16 and 17, a pair of pin tractors 148 are positioned in one side area of the printer case 101 so as to feed a sheet of paper toward the feeding rollers 112 and 114 of the first paper feeding mechanism 111. Each pin tractor 148 mainly comprises a driving pulley 149, a driven pulley 150, and a feeding belt 151 wound around both pulleys 149 and 150. Pins 152 provided on the periphery of the feeding belt 151 fit in pin feed holes spaced along the outer edges of a continuous form at particular intervals. A square driving shaft 153 extends through the driving pulley 149, and one end of the shaft 153 is connected with a pin tractor driving gear 154 which is engaged with the first intermediate gear 119.

In order to feed cut sheets of paper toward the feeding rollers 112 and 114 of the first paper feeding mechanism 111, a manual guide plate 155 is supported above the pin tractors 148 pivotably on a pin 156 to be positioned at either a horizontal state illustrated by a solid line in FIG. 17 or a slant state illustrated by an interrupted line.

Referring to FIG. 16, when the drive motor 121 is operated, the torque on the output shaft 122 is transmitted to the driving shaft 153 of the pin tractors 148 via the output gear 123 and the first intermediate gear 119, thereby rotating the feeding belt 151 in a certain direction. This rotation of the feeding belt 151 carries a continuous form toward the first paper feeding mechanism 111. Simultaneously, the torque on the output shaft 122 of the driving motor 121 is also transmitted to the driving gear 118 of the first paper feeding mechanism 111 via the output gear 123 and the first and the second intermediate gears 119 and 120. Consequently, the upper feeding roller 112 is rotated together with the upper roller shaft 113 in a certain direction, and simultaneously the lower feeding roller 114 is rotated together with the lower roller shaft 115 via the gears 116 and 117. In the second paper feeding mechanism 125, the upper feeding roller 126 is rotated together with the upper roller shaft 127 in a certain direction via the driving pulley 124, the toothed belt 132 and the driven pulley 131. Simultaneously, the lower feeding roller 128 is rotated together with the lower roller shaft 129 via the gears 130*a* and 130*b*. The sheet transferred by the pin tractors 148 is fed onto the paper guide path 102 by the rotation of the feeding rollers 112, 114, 126 and 128 in the first and second paper feeding mechanisms 111 and 125. Advancing between the printhead 105 and the platen 107, the sheet is discharged from an outlet 157 on the printer case 101.

Next, the process of rotating the platen 107 is described in detail with reference to FIGS. 13 and 14. Upon the rotation of the toothed belt 132, the collar 138 engaged with the toothed belt 132 is rotated around the platen shaft 108. The torque transmitted from the toothed belt 132 to the collar 138 is then transmitted to the intermediate member 143 via the engaging teeth 145 and 146. The torque on the intermediate member 143 is transmitted to the platen shaft 108 via the friction disk 142 on the friction member 141. If the torque on the intermediate member 143 is greater than the friction driving force between the intermediate member 143 and the friction disk 142, the intermediate member 143 slips over the friction disk 142, thereby interrupting the torque transmission to the platen shaft 108. Alternatively, if the torque on the intermediate member 143 is not greater than the friction driving force between the intermediate member 143 and the friction disk 142, then, the torque is transmitted from the intermediate member 143 to the platen shaft 108 via the friction disk 142, thereby rotating the platen 107 little by little.

When the sheet is advanced for a determined distance, e.g., a distance corresponding to a single line of a space, the drive motor 121 stops. At this moment, the platen 107 is rotated for a little amount by the inertia force due to its own weight. The torque caused by the inertia force of the platen 107 is transmitted to the collar 138 to such a degree that it is not greater than the friction driving force between the friction disk 142 on the friction member 141 and the intermediate member 142. The torque thus transmitted to the collar 138 is, however, so small that it does not cause the feeding rollers 112, 114, 126, and 126 to rotate via the collar 138 and the toothed belt 132. Even when the torque caused by the inertia force of the platen 107 is greater than the friction driving force between the friction disk 142 and the intermediate member 143, the friction disk 142 slips over the intermediate member 143, thereby interrupting the torque transmission from the platen 107 to the toothed belt 132 wound around the collar 138. More specifically, the torque due to the inertia force of the platen 107 can be kept from being transmitted to the upper roller shafts 113 nor 127 via the collar 138, the toothed belt 132 and the driving and driven pulleys 124 and 131. The inertia force of the platen 107, therefore, does not cause any of the feeding rollers 112, 114, 126 and 128 to rotate. As a consequence, the sheet of paper is fed exactly for a determined distance without excessive advancement, so that the printhead 105 executes printing on the sheet by moving along the platen 107.

Next, an explanation will be given for the method of advancing a sheet by turning the operation knob 147 by hand. When the operation knob 147 is turned to rotate in a certain direction, the torque on the operation knob 147 is sequentially transmitted to: the intermediate member 143; the collar 138; the toothed belt 132; the driving and driven gears 124 and 131; and finally to the upper roller shafts 113 and 127 in the first and second paper feeding mechanisms 111 and 125, thereby rotating the feeding rollers 112, 114, 126 and 128. Upon the rotation of the upper roller shaft 112, the feeding belt 151 on the pin tractor 148 is activated by way of: the driving gear 118; the second intermediate gear 120; the first intermediate gear 119; and the pin tractor driving gear 154, thereby advancing the sheet through manual operation. Simultaneously the torque on the operation shaft 147 is partially transmitted to the platen shaft 108 to such a degree that the transmitted torque is not greater than the friction driving force between the intermediate member 143 and the friction disk 142 on the friction member 141. As a consequence, the platen shaft 108 rotates the platen 107.

Hereinafter, a third embodiment of the present invention will be described with reference to FIG. 18. The third embodiment is different from the second embodiment in the assembly of the collar 138, the friction member 141, the intermediate member 143 and the operation knob 147 to the platen shaft 108 of the platen 107. Since the rest of the structure is almost the same as that of the second embodiment, the explanation thereof is omitted. In this embodiment, the collar 138, the friction member 141 and the intermediate member 143 are rotatably attached on the platen shaft 108. The spring 140 is provided between the collar 138 and the friction member 141 so as to force the friction disk 142 of the friction member 141 into contact with a side face of the intermediate member 143. The friction member 141 is splined with the collar 138 so as to move along the platen shaft 108 and normally transmit a torque to the collar 138.

The intermediate member 143 can move toward the collar 138 along the platen shaft 108 and the opposite face of the intermediate member 143 to the collar 138 is secured by the snap ring 144. Clutch portions 158 and 159 are provided on the opposing faces of the intermediate member 143 and the collar 138, respectively, in such a manner that the clutch portions 158 and 159 are normally separate from each other and that they are engaged with each other when the intermediate member 143 is brought into contact with the collar 138 against the spring 140.

The operation knob 147 is attached to one end of the platen shaft 108 so as to rotate together with the platen shaft 108. The operation knob 147 can move along the platen shaft 108 together with the intermediate member 143 until the clutch portion 159 on the intermediate member 143 is engaged with the opposite clutch portion 158 on the collar 138. The operation knob 147 is splined with the intermediate member 143 so as to transmit a torque therebetween.

So structured as described above, the torque is transmitted from the first and second paper feeding mechanisms 111 and 125 to the collar 138 via the toothed belt 132. Thereafter, the torque is sequentially transmitted to: the friction member 141; the intermediate member 143; the operation knob 147; and finally to the platen shaft 108. In case of advancing a sheet by manual operation of the operation knob 147, the operation knob 147 is first pushed until the intermediate member 143 is brought into contact with the collar 138, thereby engaging the clutch portion 159 on the intermediate member 143 with the clutch portion 158 on the collar 138. Thereafter, when the operation knob 147 is turned to rotate in a determined direction, the torque on the operation knob 147 is transmitted directly to the platen shaft 108 and also transmitted to the collar 138 via the intermediate member 143 and the clutch portions 158 and 159.

As many apparently widely different embodiments of this invention may be made without departing from the spirit and scope thereof, it is to be understood that the invention is not limited to the specific embodiments thereof except as defined in the appended claims.

What is claimed is:

1. A sheet feeding apparatus in a printer comprising:

a cylindrical platen rotatably attached opposite to a printhead;

a paper feeding means for feeding a sheet of paper through between said printhead and said platen; and a transmission mechanism frictionally connected with said platen for transmitting the torque on said paper feeding means to said platen so as to rotate said platen through friction drive, said transmission mechanism including a collar rotatably attached on one end of a platen shaft that extends through said platen and projects therefrom, said collar rotated in accordance with said paper feeding means for transmitting the torque on said collar to said platen shaft by way of a friction member and said friction member being connected with both said collar and said platen shaft so as to rotate together with said collar and/or said platen shaft.

2. The sheet feeding apparatus in the printer according to claim 1 wherein said collar has teeth around its periphery that are engaged with a toothed belt so as to connect said collar with said paper feeding means.

3. The sheet feeding apparatus in the printer according to claim 2 wherein:

said paper feeding means comprises a first paper feeding means and a second paper feeding means;

said first and second paper feeding means are individually located at a first position before said platen and at a second position after said platen in the paper feed direction; and said first and second paper feeding means are connected with each other by said toothed belt in order to be activated synchronously with each other.

4. The sheet feeding apparatus in the printer according to claim 3 wherein each of said first and second paper feeding means includes a pair of rollers that holds the sheet between said rollers.

5. The sheet feeding apparatus in the printer according to claim 1 wherein said transmission mechanism comprises a manual operation member that is rotatable by hand for activating said paper feeding means, and for rotating said platen through the friction drive, thus advancing the sheet in the printer.

6. The sheet feeding apparatus in the printer according to claim 1 wherein:

said collar is connected with a manual operation member so as to rotate together; and said paper feeding means is activated by way of said collar when said manual operation member is manually rotated, thus advancing the sheet in the printer.

7. The sheet feeding apparatus in the printer according to claim 1 wherein:

said platen shaft includes a manual operation member;

said sheet feeding apparatus comprises a pair of clutch members that are removably engaged with each other between said collar and said manual operation member; and said paper feeding means is activated by said collar simultaneously with the rotation of said platen when said manual operation member is manually rotated with said clutch members being engaged with each other, thus advancing the sheet in the printer.

8. The sheet feeding apparatus in the printer according to claim 4 wherein said first and second paper feeding means are located such that the respective contact points of said pairs of rollers of said first and second paper feeding means are both situated substantially on a tangent line of a periphery of said platen.

9. The sheet feeding apparatus in the printer according to claim 3 in which said first paper feeding means comprises a first roller and an opposite second roller, and said second paper feeding means comprises a third roller and an opposite fourth roller; said sheet feeding apparatus further comprising:

a first paper path including pin tractors for feeding a first type of sheet, which is provided with pin feed holes on both side edges thereof, toward said first paper feeding means by means of said pin tractors whose pins fit in the pin feed holes on said first type of sheet;

a second paper path for guiding a second type of sheet toward said first paper feeding means;

a torque transmission means for connecting said pin tractors with a driving source of said first and second paper feeding means by way of a clutch means which can be selectively connected and disconnected;

an operation means for shifting at least said first roller so as to selectively attach and detach said first roller to and from said second roller; and an interlocking means for connecting said clutch means when said operation means detaches said first roller from said second roller, and for disconnecting said clutch means when said operation means attaches said first roller to said second roller.

10. The sheet feeding apparatus in the printer according to claim 9 wherein said operation means shifts said second paper feeding means so as to selectively attach and detach said third roller to and from said fourth roller, and said operation means is selectively set in:

a first position for attaching said first roller to said opposite second roller, and for attaching said third roller to said opposite fourth roller;

a second position for detaching said first roller from said second roller, and for attaching said third roller to said fourth roller; and a third position for detaching said first roller from said second roller, and for detaching said third roller from said fourth roller.

11. The sheet feeding apparatus in the printer according to claim 10 wherein:

said operation means comprises a pair of manually operable cams, and a first lever and a second lever each individually moved by its respective cam; and said first roller is rotatably attached to said first lever, and said third roller is rotatably attached to said second lever.

12. The sheet feeding apparatus in the printer according to claim 9 wherein:

a first spring forces said first and second rollers into contact with each other, and a second spring forces said third and fourth rollers into contact with each other; and said first spring has stronger resiliency than said second spring.

13. The sheet feeding apparatus in the printer according to claim 1, wherein said friction drive allows slip to prevent the transmission of inertial torques greater than a predetermined magnitude from being transmitted from the cylindrical platen to the paper feeding means to avoid undesired rotation of the paper feeding means.

* * * * *